United States Patent [19]

Roberts

[11] 3,954,458

[45] May 4, 1976

[54] DEGASSING POWDER METALLURGICAL PRODUCTS

[75] Inventor: Sidney G. Roberts, Livermore, Calif.

[73] Assignee: Kaiser Aluminum & Chemical Corporation, Oakland, Calif.

[22] Filed: Nov. 12, 1973

[21] Appl. No.: 414,658

[52] U.S. Cl. ..... 75/200; 75/211; 75/226; 29/182; 148/126

[51] Int. Cl.[2] ..... B22F 1/00

[58] Field of Search ..... 75/211, 226, 200; 148/126; 29/182

[56] References Cited

UNITED STATES PATENTS

| | | | |
|---|---|---|---|
| 3,544,394 | 12/1970 | Lyle et al. | 75/226 |
| 3,563,814 | 2/1971 | Lyle et al. | 148/12.7 |
| 3,637,441 | 1/1972 | Lyle et al. | 148/32.5 |

FOREIGN PATENTS OR APPLICATIONS

| | | | |
|---|---|---|---|
| 1,200,969 | 8/1970 | United Kingdom | 75/211 |

OTHER PUBLICATIONS

U.S. Army Contract DAAA25-72-C0593, June 11, 1973, Alcoa-Frankford Arsenal.

*Primary Examiner*—Benjamin R. Padgett
*Assistant Examiner*—B. H. Hunt
*Attorney, Agent, or Firm*—Paul E. Calrow; Edward J. Lynch

[57] ABSTRACT

This invention relates to a method of degassing prealloyed aluminum powder or compacts formed therefrom wherein the metal products are degassed by being subjected to a temperature between 450° and 850°F at a pressure less than $10^{-3}$ torr. The products of this process are characterized by high strength and fracture toughness and excellent corrosion resistance.

12 Claims, No Drawings

DEGASSING POWDER METALLURGICAL PRODUCTS

BACKGROUND OF THE INVENTION

This invention relates to an improved method of preparing high strength aluminum products from prealloyed aluminum powder.

The utilization of prealloyed aluminum powder in forming high strength aluminum products is well known. In the prior art, these products were characterized by superior strength and corrosion resistance in comparison with conventionally cast products but were usually deficient in ductility and toughness.

The improved properties of products of prealloyed powders are often the result of the high freezing rate of the powder particles formed during atomization. Due to the drastic chill of the molten particles, a large amount of alloying elements can be frozen into the aluminum matrix without the massive chemical segregation characteristic of conventionally cast products containing very high levels of alloying elements.

Prior art compositions of the prealloyed aluminum powder were generally of the precipitation-hardening or dispersion-hardening type aluminum alloys. Frequently dispersoid forming additions of transition elements, such as cobalt, iron, manganese, nickel, chromium, zirconium and the like, are added to the heat treatable alloys to improve the properties thereof. Typical compositions are set forth below.

Recent advances in the powder metallurgical art have improved substantially the tensile strength, elongation and stress corrosion resistance particularly with solutionn heat treated and aged Al-Zn-Mg type alloys. However, attendant with the outstanding properties was a relatively low fracture toughness.

Against this background, the present invention was developed.

DESCRIPTION OF THE INVENTION

The present invention is generally directed to an improved method of preparing high strength aluminum articles from prealloyed aluminum base powders and in particular is directed to improved method of degassing the powder or porous intermediate product to provide substantially improved combinations of strength, ductility and fracture toughness.

In accordance with the present invention, the prealloyed powder or a green compact formed therefrom is subjected to a pressure of less than $10^{-3}$ torr ($10^{-3}$ mm mercury at 0°C), preferably less than $10^{-4}$ torr, at a temperature of about 450° to 850°F, preferably about 600° to 800°F, to remove water, hydrogen and other contaminants from the powder or green compact. The time for degassing ranges from about 30 minutes to about 48 hours at the degassing temperature. The time will vary depending upon the size of the article, the degree of compaction, capacity of the evacuating system and the like. The degassing procedures of the present invention provide products which have an outstanding ratio of notch tensile strength to yield at very high levels of yield strength, this being a good indication of the fracture toughness of the material.

| Alloy Compositions | | | | | | | | | | | |
|---|---|---|---|---|---|---|---|---|---|---|---|
| Fe | Cu | Mn | Mg | Cr | Ni | Zn | Ti | Co | Zr | V | Al |
| — | 0–3 | 0–3 | 1.75–6.0 | 0–1.25 | — | 5–13 | — | 0–3 | 0–0.25 | — | Bal[1] |
| .5–4.5 | 0–3 | 0–3 | 1.75–6.0 | 0–1.25 | .5–6 | 6.5–13 | — | — | — | — | Bal[1] |
| 2–20 | — | 0–10[2] | — | 0–10[2] | 0–10[2] | | 0–10[2] | 0–10[2] | 0–10$_2$ | 0–2[2] | Bal[1] |
| 0–3 | 4–12 | 0–6 | — | 0–2 | — | — | — | — | 0–3 | 0–2 | Bal[1] |

[1]Balance aluminum and inconsequential amounts of other elements
[2]Total of these elements not to exceed 10%

In the prior art, a procedure which was found suitable for producing products from prealloyed aluminum powders is as follows:

1. Selecting a prealloyed powder of a particular size range, usually −100 mesh;
2. Cold compacting to form a 70 to 90% dense green compact;
3. Degassing the green compact to reduce contaminants, such as water vapor and $H_2$ which are known to cause degradation of the final product;
4. Hot compacting the green compact to full density;
5. Hot working to the desired shape; and
6. Solution heat treating and aging if the alloy is a precipitation-hardening type alloy.

The degassing treatment was normally conducted by exposing the powder or green billet to temperatures in the range of 900° to 1050°F either in an inert atmosphere or a partial vacuum. These conditions were necessary to reduce the contaminants of the powders to a level which would prevent the development of surface blisters and/or large amounts of internal porosity in the final product. Prior investigators have conducted degassing at intermediate temperatures (e.g., 750°F) in an inert atmosphere, but they found the degassing procedure very inefficient in removing contaminants and poor mechanical properties in the resultant products.

The oxide surface of the powdered aluminum is quite active with respect to moisture, tending to sorb moisture both chemically and physically at room temperature. The resulting hydrated oxide dehydrates at high temperature, causing internal porosity and sometimes blisters on the surface of any subsequent wrought product. Prior art techniques generally emphasized that a very high temperature degassing treatment was necessary to drive off both the physically and chemically sorbed water. However, it is presently believed that this high temperature degassing treatment negated many of the microstructural advantages of powder metallurgical techniques. At the higher temperatures (above about 900°F) the mobility of the alloying elements is quite high and as a result, agglomeration of the alloying elements occurs, thereby reducing the fracture toughness of the material. With the process of the present invention, the powder or a compact formed therefrom is effectively degassed but without the agglomeration of the alloying elements characteristic of the prior art.

Preferably, in the degassing treatment of the present invention, the temperature ranges from about 600° to 800°F and the pressure is less than $10^{-4}$ torr. If a green compact is formed, the density thereof should not exceed 90% of full density because at such a high density, much of the gaseous products are trapped and cannot be removed by the degassing treatment. Densities between 50 and 85% of full density are adequate.

After degassing, the material is hot pressed to full density, then hot worked in a suitable manner, such as by extruding, forging, rolling and the like. If the alloy composition is heat treatable, the hot worked article is solution heat treated and aged to the desired strength levels.

It has been found that Al-Zn-Mg-Cu prealloyed powders formed into products in accordance with the present invention provide products having yield strengths exceeding 100,000 psi in a —T6 temper with elongations exceeding 9%. In a slightly overaged conditions, i.e., —T7 temper, ratios of notch tensile strength to yield strength ($K_t > 12$) have been obtained greater than 1.15 at a yield strength level of 95,000 psi and above. It is believed that these properties have never been obtained heretofore with an aluminum alloy.

The process of the present invention has wide applicability and can be utilized in preparing products from both precipitation-hardened or dispersion-hardened aluminum alloys. Suitable alloys are given in the table below.

| Alloy System | % Si | % Fe | % Cu | % Mn | % Mg | % Cr | % Ni | % Zn | % Ti | % Zr | % Co | % Al |
|---|---|---|---|---|---|---|---|---|---|---|---|---|
| | Prealloyed Aluminum Powder Compositions - Weight Per Cent | | | | | | | | | | | |
| Al-Zn-Mg-Cu | 0.05 to 1.50* | 0.05 to 3.50* | 0.25 to 4.00 | 0.20 to 3.00* | 0.50 to 4.50 | 0.10 to 2.00* | 0.10 to 3.50* | 5.00 to 13.00 | 0.05 to 0.75* | 0.05 to 0.75* | 0.20 to 2.50* | Bal |
| Al-Cu | 0.20 to 2.00* | 0.05 to 3.50* | 2.50 to 7.50 | 0.20 to 3.00* | 0.25 to 2.50* | 0.10 to 2.00* | 0.10 to 4.00* | 0.50 to 3.50* | 0.05 to 0.75* | 0.05 to 0.75* | 0.20 to 3.50* | Bal |
| Al-Mg | 0.05 to 1.00* | 0.10 to 4.00* | 0.20 to 1.00* | 0.50 to 4.50* | 2.00 to 10.00 | 0.10 to 2.00* | 0.10 to 4.00* | — | 0.05 to 1.00* | 0.05 to 1.00* | 0.10 to 5.00* | Bal |
| Al-Mn | 0.05 to 1.00* | 0.05 to 3.50* | — | 1.50 to 10.00 | 0.30 to 3.00* | 0.10 to 1.00* | 0.10 to 4.00* | — | 0.10 to 2.00* | 0.10 to 4.00* | 0.10 to 4.00* | Bal |
| Al-Fe | 0.05 to 1.00* | 4.00 to 12.00 | — | 0.20 to 4.00* | 0.30 to 3.00* | 0.10 to 2.50* | 0.10 to 5.00* | — | 0.10 to 2.50* | 0.10 to 2.50* | 0.10 to 5.00* | Bal |

*Ancillary alloy additions, with the total ancillary alloy additions preferably not exceeding 5.0%

In addition to the alloying elements set forth above, the above alloys may contain from about 0.10 to 5% of elements selected from the group consisting of zirconium, cobalt, vanadium, niobium, tantalum, scandium and rare earth elements. However, the total ancillary alloying elements should not exceed 5%.

To further illustrate embodiments of the present invention, the following prealloyed aluminum base powders were prepared by atomizing in a dry 94% nitrogen — 6% oxygen gas mixture.

| Alloy No. | Zn | Mg | Si | Fe | Cu | Co | Zr | Be | Al |
|---|---|---|---|---|---|---|---|---|---|
| 1 | 8.7 | 2.5 | .03 | .03 | 1.25 | .9 | — | .003 | Bal |
| 2 | 9.1 | 2.5 | .04 | .08 | 1.25 | — | .23 | .003 | Bal |
| 3 | 9.0 | 2.5 | — | — | 1.25 | — | .16 | .003 | Bal |

The liquid melts for these powders were prepared using a 99.85% aluminum base with the appropriate alloy additions. In addition, 0.003% beryllium was added to each melt to reduce oxidation. The powdered aluminum alloys were screened to obtain a −100 +325 mesh fraction. Metallographic examination of this fraction of powder indicated that the dendritic cell size in the largest particles was in the range of 2-14 3.5 microns. Twenty-pound portions of each powder composition were isostatically compacted at 45 ksi to yield a four-inch diameter compact with a density of about 80% of full density. The green compacts were enclosed in welded aluminum cans suitably adapted for evacuation and then degassed as set forth below.

| Alloy No. | Temp,°F. | Time,Hrs. | Pressure torr |
|---|---|---|---|
| 1 | 600 | 4 | $4 \times 10^{-5}$ |
| | 600 | 48 | $2 \times 10^{-5}$ |
| 2 | 600 | 4 | $5 \times 10^{-5}$ |
| 3 | 700 | 24 | $2.8 \times 10^{-5}$ |

At the completion of these treatments, the cans were sealed to retain the vacuum and the degassed green compacts were immediately compacted at 113 ksi to essentially full density. After scalping the can from the compacted billets, they were extruded to form 1 ½ inch diameter rods. Samples of the rod were solution heat treated at a temperature of 880°F for about 1 hour then cold water quenched. After quenching, samples of the rod were artificially aged to the —T6 temper by heating for 24 hours at 250°F. To obtain a —T7 type temper, the previously aged samples were heated at a rate of 100°F per hour to a temperature of 325°F, held at that temperature for 6 hours and then air cooled. These samples showed that the longitudinal tensile properties of the extrusions were as set forth in the table below.

| Alloy No. | Temper | TS (ksi) | YS (ksi) | Elong,% | NTS ($K_t$>12) | NTS/YS |
|---|---|---|---|---|---|---|
| 1 | —T6 | 112.2 | 108.8 | 9.5 | — | — |
| | —T6 | 114.0 | 110.1 | 9.0 | — | — |
| 2 | —T6 | 109.9 | 106.6 | 9.0 | — | — |
| | —T6 | 107.8 | 104.6 | 9.5 | — | — |
| 3 | —T6 | 111.7 | 108.8 | 11.0 | 107.2 | 0.98 |
| | —T7 | 99.3 | 97.8 | 11.5 | 116.0 | 1.18 |
| | —T6 | 109.1 | 106.3 | 10.0 | 102.0 | 0.96 |
| | —T7 | 97.9 | — | — | 113.4 | 1.18 |

The measured properties in the transverse direction were considerably lower due in part to an insufficient deformation of the coarse powder particles in the center of the extrusion and in part to a small amount of residual porosity resulting from the high degree of compaction of the green compacts. By varying the powder size, reducing the green compact density and increasing the amount of hot working, this deficiency can be avoided.

It is obvious that various modifications and improvements can be made to the present invention without departing from the spirit thereof and the scope of the appended claims. All percentages set forth herein are per cent weight unless noted otherwise.

What is claimed is:

1. In the method of forming products from prealloyed aluminum powder wherein prealloyed aluminum powder having a particle size less than 100 mesh is degassed, compacted to full density and then hot worked, the improvement comprising conducting said degassing at a temperature between 450° and 850° and at a pressure of less than $10^{-3}$ torr.

2. The method of claim 1 wherein said degassing temperature is maintained from about 600°–800°F.

3. The method of claim 1 wherein said pressure is less than $10^{-4}$ torr.

4. The method of claim 1 wherein said prealloyed aluminum powder is formed from an alloy consisting essentially of about 5 to 13% zinc, from about 0.5 to 4.5% magnesium, up to about 4.0% copper, up to about 3.0% cobalt, up to about 0.5% zirconium and the balance aluminum and inconsequential amounts of other elements.

5. The product formed by the method of claim 4.

6. In the method of forming products from prealloyed aluminum powder wherein prealloyed aluminum powder having a particle size less than 100 mesh is compacted into a green compact less than 90% of full density, and then degassed, and the degassed green compact is compacted to full density and then hot worked, the improvement comprising conducting said degassing at a temperature between 450° and 850°F and at a pressure of less than $10^{-3}$ torr.

7. The method of claim 6 wherein said prealloyed powder is first compacted into a green compact to about 50 to 85% of full density and degassed.

8. The method of claim 6 wherein said degassing temperature is maintained from about 600°–850°F.

9. The method of claim 6 wherein said prealloyed powder is compacted into a green compact to about 50–85% of full density and then degassed.

10. The method of claim 6 wherein said pressure is less than $10^{-4}$ torr.

11. The method of claim 6 wherein said prealloyed aluminum powder is formed from an alloy consisting essentially of about 5–13% zinc, from about 0.5–4.5% magnesium, up to about 4.0% copper, up to about 3.0% cobalt, up to about 0.5% zirconium and the balance aluminum and inconsequential amounts of other elements.

12. The product formed by the method of claim 9.

* * * * *

UNITED STATES PATENT OFFICE

CERTIFICATE OF CORRECTION

PATENT NO. : 3,954,458

DATED : May 4, 1976

INVENTOR(S) : Sidney G. Roberts

It is certified that error appears in the above-identified patent and that said Letters Patent are hereby corrected as shown below:

Column 2, line 42, "yield at" should be --yield strength at--

Column 4, line 2, "range of 2-14 3.5" should be --range of 2-3.5--

Signed and Sealed this

Thirteenth Day of July 1976

[SEAL]

*Attest:*

RUTH C. MASON
*Attesting Officer*

C. MARSHALL DANN
*Commissioner of Patents and Trademarks*